US009881548B2

(12) United States Patent
Park et al.

(10) Patent No.: US 9,881,548 B2
(45) Date of Patent: Jan. 30, 2018

(54) ORGANIC LIGHT EMITTING DIODE DISPLAY WITH SHIELDING PORTION

(71) Applicant: SAMSUNG DISPLAY CO., LTD., Yongin, Gyeonggi-Do (KR)

(72) Inventors: Jong-Hyun Park, Cheongju-si (KR); Jeong Hwan Kim, Suwon-si (KR); Sun Park, Suwon-si (KR); Chun Gi You, Asan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 138 days.

(21) Appl. No.: 14/724,041

(22) Filed: May 28, 2015

(65) Prior Publication Data

US 2016/0104420 A1 Apr. 14, 2016

(30) Foreign Application Priority Data

Oct. 8, 2014 (KR) ..... 10-2014-0136204

(51) Int. Cl.
*G09G 3/3225* (2016.01)

(52) U.S. Cl.
CPC ... *G09G 3/3225* (2013.01); *G09G 2300/0465* (2013.01)

(58) Field of Classification Search
CPC ..... G02F 1/13762; G09G 2300/0465; G09G 3/3225
See application file for complete search history.

(56) References Cited

U.S. PATENT DOCUMENTS

2002/0060756 A1* 5/2002 Kurashina ..... G02F 1/136213 349/39
2003/0122140 A1* 7/2003 Yamazaki ..... H01L 21/67207 257/88
2004/0124432 A1* 7/2004 Ko ..... H01L 51/5281 257/99
2010/0001932 A1* 1/2010 Kishi ..... G09G 3/3225 345/77
2010/0259920 A1* 10/2010 Lin ..... F21S 4/28 362/97.1
2011/0175881 A1* 7/2011 Kim ..... G09G 3/3225 345/211
2012/0252211 A1 10/2012 Meulen et al.
2013/0002960 A1* 1/2013 Ryu ..... G09G 3/3225 348/607

(Continued)

FOREIGN PATENT DOCUMENTS

KR 10-0692864 3/2007
KR 10-1035927 5/2011
KR 10-2012-0045470 A 5/2012

*Primary Examiner* — Ibrahim Khan
(74) *Attorney, Agent, or Firm* — Lee & Morse, P.C.

(57) ABSTRACT

An organic light emitting diode display includes at least one first data line, at least one second data line, a plurality of driving transistors, and a plurality of light emitters. Each driving transistor has a driving gate electrode connected to the at least one first data line and the at least one second data line, and the light emitters are respectively connected to the driving transistors. Emission regions of the light emitter do not overlap the at least one first data line, the at least one second data line, and the driving transistors. A shielding portion overlaps an end of the at least one first data line and an end of the at least one second data line.

17 Claims, 5 Drawing Sheets

(56) References Cited

U.S. PATENT DOCUMENTS

2014/0167009 A1* 6/2014 Lee ..... H01L 27/3272
257/40
2015/0092128 A1* 4/2015 Lee ..... H01L 27/0296
349/40

* cited by examiner

ORGANIC LIGHT EMITTING DIODE DISPLAY WITH SHIELDING PORTION

CROSS-REFERENCE TO RELATED APPLICATION

Korean Patent Application No. 10-2014-0136204, filed on Oct. 8, 2014, and entitled, "Organic Light Emitting Diode Display," is incorporated by reference herein in its entirety.

BACKGROUND

1. Field

One or more embodiments herein relate to an organic light emitting diode display.

2. Description of the Related Art

An organic light emitting diode (OLED) display is a self-luminous device that does not require a separate light source (e.g., a backlight) to display images. Compared to other types of displays, an OLED display is lighter and thinner, and has high-quality characteristics such as low power consumption and high luminance and reaction speed.

Increasing resolution continues to be a focus of system designers. However, as the number of pixels increases in an OLED device, the number of wires may also increase. This increases the complexity of the display and the cost of fabrication.

SUMMARY

In accordance with one or more embodiment, an organic light emitting diode display includes a substrate; at least one first data line on the substrate and extending in a direction of an imaginary line; at least one second data line separated from the at least one first data line and extending in the direction of the imaginary line; a plurality of driving thin film transistors, each of the driving thin film transistors having a driving gate electrode connected to the at least one first data line and the at least one second data line; and a plurality of organic light emitting elements respectively connected to the driving thin film transistors.

Emission regions of the organic light emitting element may not overlap the at least one first data line, the at least one second data line, and the driving thin film transistors. The organic light emitting diode display may include a shielding portion respectively overlapping an end of the at least one first data line and an end of the at least one second data line. The shielding portion may be at a same layer as the driving gate electrode.

The organic light emitting diode display may include a plurality of scan lines separated from each other and extending in a direction crossing the imaginary line. The scan lines may be between the substrate and the at least one first data line, and wherein the shielding portion is included in at least one of the scan lines. The scan lines may be at a same layer as the driving gate electrode.

The organic light emitting diode display may include a switching driving thin film transistor including a switching gate electrode connected to the scan line and connected between one of the at least one first data line or the at least one second data line and the driving gate electrode; and a driving power source line connected to the driving thin film transistor. The organic light emitting diode display may include a capacitor including capacitor electrodes respectively connected to the driving power source line and the driving gate electrode.

The organic light emitting element may include a first electrode on the substrate; a second electrode on the first electrode; and an organic emission layer between the first and second electrodes. The first electrode may be a light translucent electrode; and the second electrode may be a light reflection electrode. The shielding portion may be at a same layer as the first electrode and may have substantially an island shape.

The shielding portion may include a first transparent conductive layer on the substrate; a metal reflection layer on the first transparent conductive layer; and a second transparent conductive layer on the metal reflection layer.

The organic light emitting diode display may include a plurality of first data lines; a plurality of second data lines; and the first data lines and the second data lines are separated from each other in a direction crossing the direction of the imaginary line. The organic light emitting diode display may include at least one first data driver connected to the first data lines; and at least one second data driver connected to the second data lines. The organic light emitting diode display may include a plurality of first data drivers; and a plurality of second data drivers. The first data driver and the second data driver may respectively include a printed circuit board.

In accordance with one or more other embodiments, an organic light emitting diode display includes at least one first data line; at least one second data line; a shielding portion respectively overlapping an end of the at least one first data line and an end of the at least one second data line; a number of driving transistors, each of the driving transistors having a gate electrode connected to the at least one first data line and the at least one second data line. the number of driving transistors connected to the number of light emitters. An emission region of the light emitter may not overlap the at least one first data line, the at least one second data line, and the driving transistor. The number of driving transistors and the number of light emitters may each be two or more.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
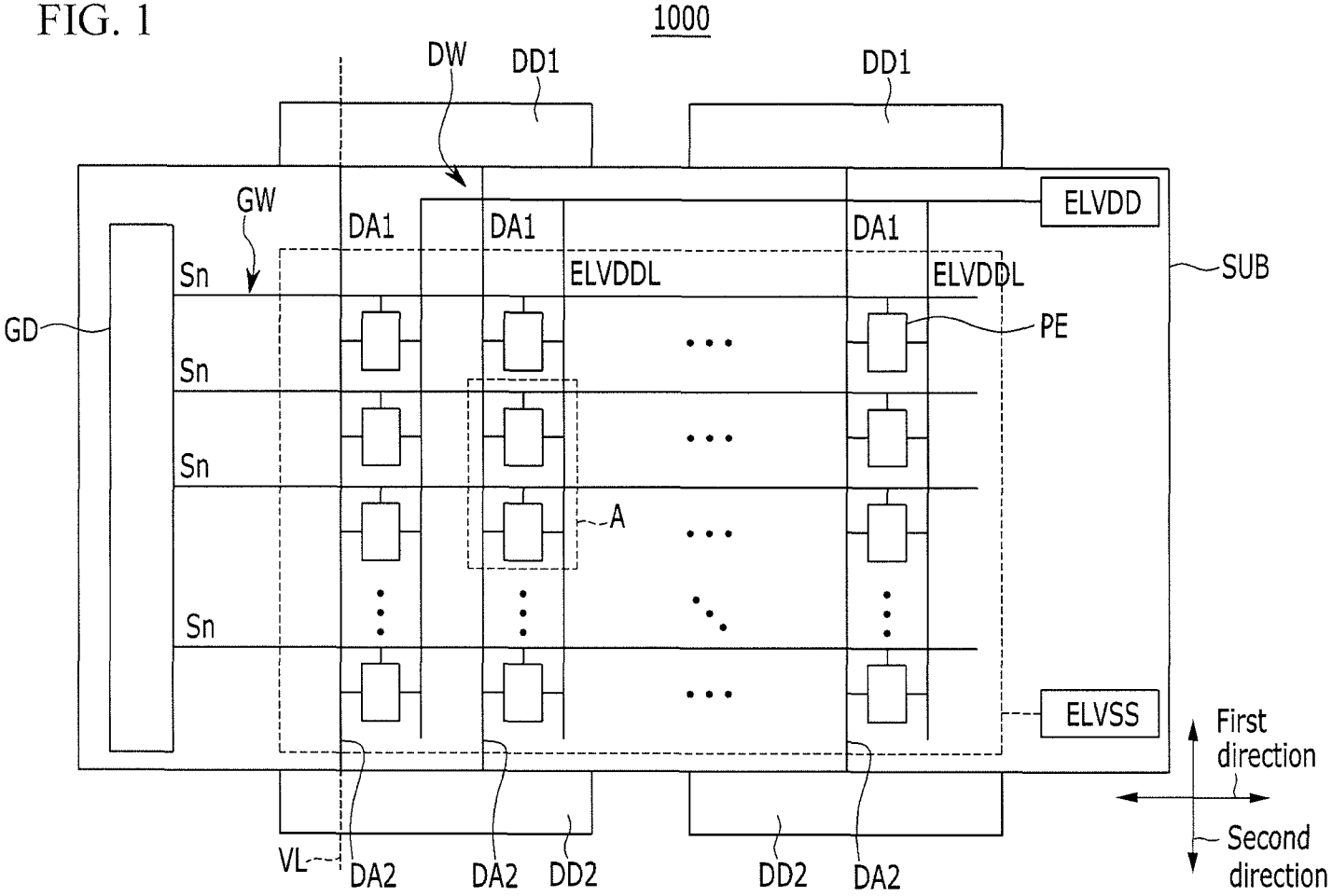
FIG. 1 illustrates an embodiment of an organic light emitting diode display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout. Embodiments may be combined to form new embodiments.

FIG. 1 illustrates an embodiment of an organic light emitting diode display 1000 which includes a substrate SUB, a gate driver GD, gate wires GW, a first data driver DD1, a second data driver DD2, data wires DW, and a number of pixels PE. A pixel PE may be considered to be a minimum unit for emitting light during the display of an image. For example, pixel PE may be a sub-pixel or a unit pixel which includes a plurality of sub-pixels. The organic light emitting diode display 1000 displays images based on light emitted by the pixels PE. The number of pixels may be one or more.

The substrate SUB may be a transparent light-transmissive substrate which includes, for example, glass, quartz, ceramic, or plastic. In another embodiment, the substrate SUB may be a substrate which includes metal, e.g., stainless steel. When the substrate SUB includes plastic, the organic light emitting diode display 1000 may have flexible, stretchable, rollable, foldable, and/or bendable characteristics.

The gate driver GD sequentially supplies a scan signal to the gate wires (GW) based on a control signal from a control circuit, e.g., a timing controller. A pixel PE is selected based on the scan signal to sequentially receive a data signal.

The gate wires GW are on the substrate SUB and include a plurality of scan lines Sn. The scan lines Sn extend in a first direction crossing an imaginary line VL. and are separated from each other in a second direction in which the imaginary line VL extends. The scan lines Sn receive a scan signal from the gate driver GD.

In one embodiment, the gate wires GW may include an additional scan line, an initial power source line, and/or an emission control line. In this case, the organic light emitting diode display may be an active matrix (AM)-type of organic light emitting diode display with pixels having, for example, a 6Tr-2Cap structure or a 7Tr-1Cap structure.

The first data driver DD1 supplies data signals to the first data lines DA1 based on control signals, for example, output from a timing controller. The data signals supplied to the first data lines DA1 are selected by corresponding scan signals supplied to the scan lines Sn. The data signals are then supplied to respective ones of the pixels PE connected to first data lines DA1. Each pixel PE is charged with a voltage based on a corresponding one of the data signals and emits light with a corresponding luminance.

The first data driver DD1 is at an upper side of the substrate SUB and may supply data signals to the pixels PE at the upper side region of the substrate SUB. In one embodiment, the display device includes a plurality of first data drivers DD1, e.g., two or more. The first data drivers DD1 respectively supply data signals to pixels PE at different regions in the upper side of the substrate SUB. Each first data driver DD1 may include a printed circuit board (PCB) including a driving IC.

The second data driver DD2 supplies data signals to the second data lines DA2 based on control signals from a control circuit, e.g., a timing controller. The data signals supplied to the second data line DA2 are selected by corresponding scan signals on the scan lines Sn, and are supplied to pixels PE connected to the second data line DA2. Thus, each pixel PE charges a voltage corresponding to a corresponding data signal and emits light with a corresponding luminance.

The second data driver DD2 is at a lower side of the substrate SUB, and supplies data signals to pixels PE in the lower side region of the substrate SUB. In one embodiment, the display device may include a plurality of second data drivers DD2, e.g., two or more. The second data drivers DD2 respectively supply data signals to pixels PE in different regions in the lower side of the substrate SUB. The second data driver DD2 may include a printed circuit board (PCB) mounted with a driving IC.

The data wires DW cross the gate wires GW on the substrate SUB, and extend in the second direction in which the imaginary line VL extends. The data wires DW includes a first data line DA1, a second data line DA2, and a driving power source line ELVDDL.

The first data line DA1 in the direction of the imaginary line VL and is connected to the first data driver DD1. The first data line DA1 receives a data signal from the first data driver DD1. A plurality of first data lines DA1 may be provided. In this case, the first data lines DA1 are separated from each other in the first direction crossing the direction of the imaginary line VL.

The second data line DA2 is separated from the first data line DA 1. extends in the direction of the imaginary line VL. and is connected to the second data driver DD2. The second data line DA2 receives a data signal from the second data driver DD2. A plurality of second data lines DA2 may be provided in plural. In this case. the second data lines DA1 are separated from each other in the first direction crossing the direction of the imaginary line VL.

The driving power source line ELVDDL is connected to the external first power source ELVDD and is supplied with the driving power source from the first power source ELVDD.

Each pixel PE is at a region where respective ones of the gate wires GW and the data wires DW cross and are connected to these wires. In one embodiment, each pixel PE includes two thin film transistors and a capacitor that are selectively connected to the first power source ELVDD, the gate wires GW, and the data wires DW, and an organic light emitting element connected to the thin film transistor and the second power source ELVSS. The pixel PE is selected when the scan signal is supplied to the scan line Sn. The voltage corresponding to the data signal is charged through the first data line DA1 or the second data line DA2, and the light of a luminance corresponding to the charged voltage is emitted.

Figure 2:
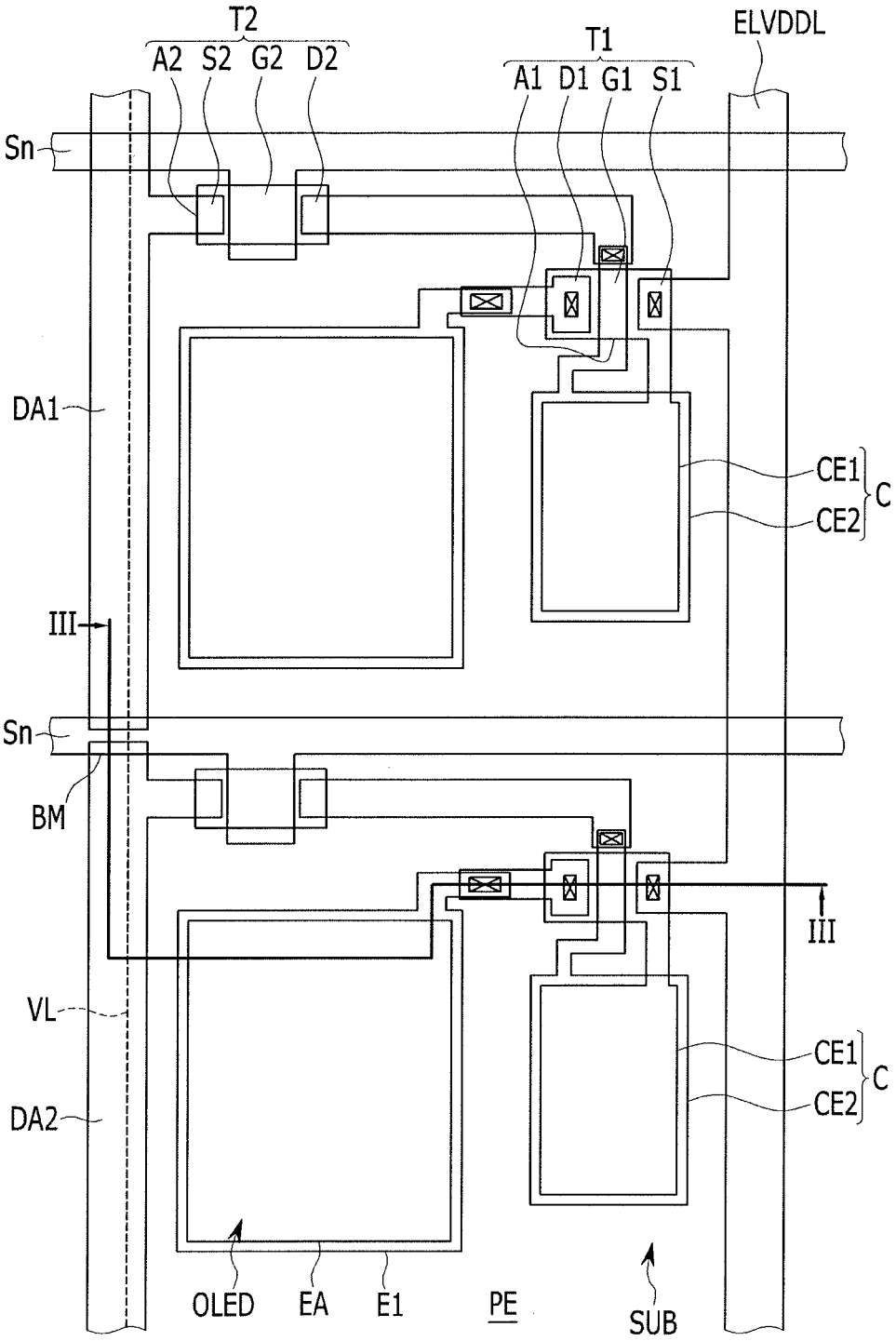
FIG. 2 illustrates a layout view of portion A in FIG. 1.
Figure 3:
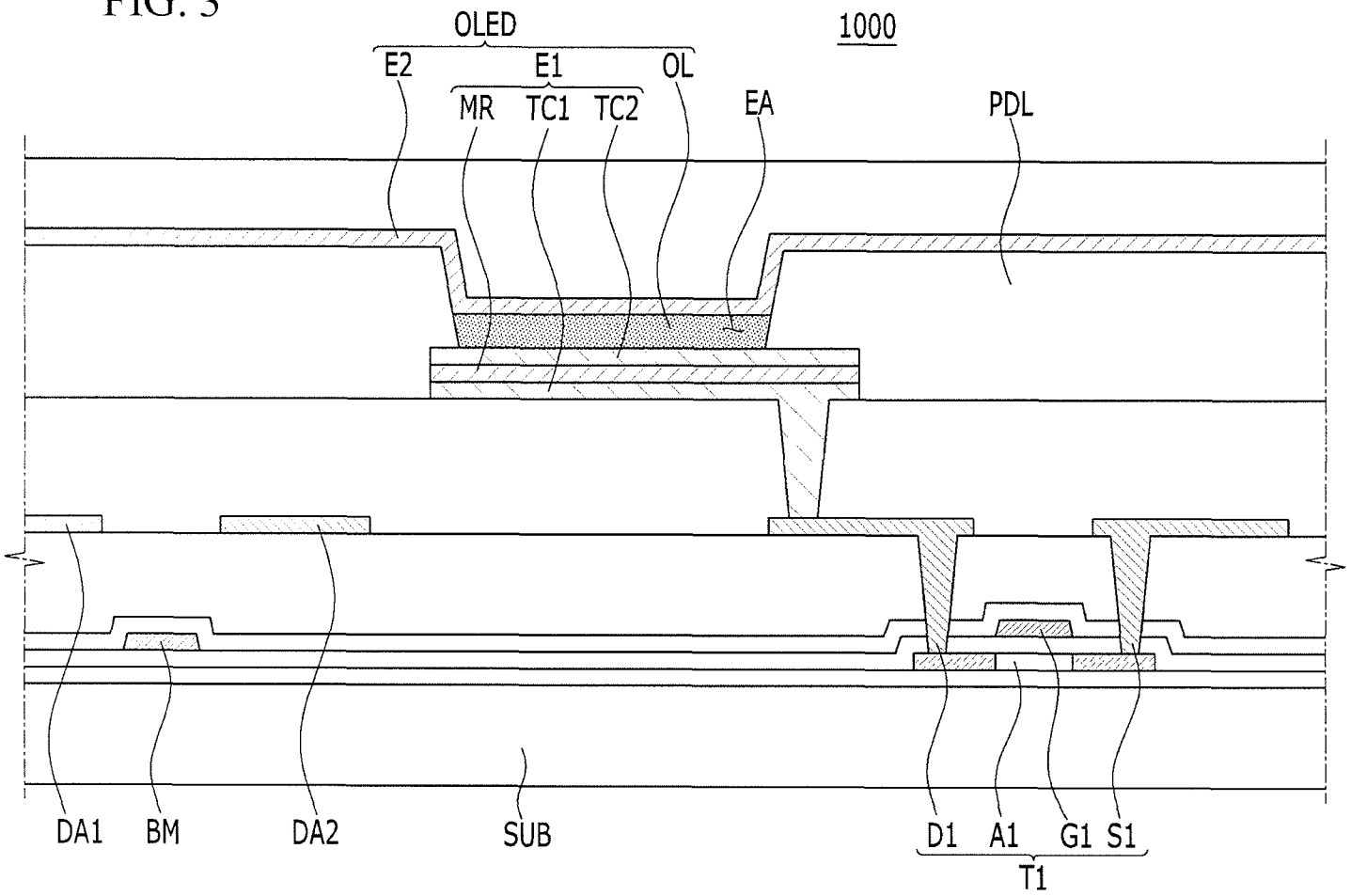
FIG. 3 illustrates a view along section line of FIG. 2.

FIG. 2 illustrates an example of portion A of the organic light emitting diode display 1000 in FIG. 1. FIG. 3 is a cross-sectional view taken along a line in FIG. 2. As illustrated in FIG. 2 and FIG. 3, in this embodiment pixel PE has a 2Tr-1Cap structure which includes the organic light emitting diode OLED, two thin film transistors TFT T1 and T2, and one capacitor C. The pixel PE may have a different structure, e.g., a different number of transistors and/or capacitors in another embodiment. For example in one non-limiting embodiment, each pixel PE may have three or more thin film transistors and/or two or more capacitors.

The organic light emitting element OLED includes a first electrode E1 as an anode electrode serving as a hole injection electrode, a second electrode E2 as a cathode electrode serving as an electron injection electrode, and an organic emission layer OL disposed between the first electrode El and the second electrode E2. The emission region (EA) of the organic light emitting element OLED does not overlap the gate wires GW including the scan line Sn, the data wires DW including the first data line DA1, the second data line DA2, and the driving power source line ELVDDL, the two thin film transistors T1 and T2, and the capacitor C. The emission region EA of the organic light emitting element OLED may correspond to a pixel definition layer PDL exposing a portion of the first electrode E1.

The first electrode E1 may be a light translucent electrode including a first transparent conductive layer TC1 including a transparent conductive material (e.g., indium tin oxide (ITO)), a metal reflection layer MR on the first transparent conductive layer TC1 and including a metal material (e.g., silver (Ag)), and a second transparent conductive layer TC2 on the metal reflection layer MR and including the transparent conductive material, e.g., indium tin oxide.

The second electrode E2 is a light reflection electrode including a conductive or metal material formed as a rear layer.

The organic emission layer OL may include an emission layer which selectively emits different colors of (e.g., red, blue. green) light. three or more emission layers which respectively emit different colors of (e.g., red, blue, green) light, or one or more an emission layers that emit white light.

By forming the first electrode E1 as the light translucent electrode and the second electrode E2 as the light reflection electrode, light emitted from the organic emission layer OL is reflected by the second electrode E2 and is emitted in the direction of the first electrode E1, thereby displaying an image in the direction of the substrate SUB. The organic light emitting diode display 1000 may, for example, be a bottom emission type of display device or a front emission type of display device, or both a front and bottom emission type of display device.

The two thin film transistors T1 and T2 include a switching thin film transistor T2 and a driving thin film transistor T1. The switching thin film transistor T2 includes a switching gate electrode G2, a switching active layer A2, a switching source electrode S2, and a switching drain electrode D2. The switching gate electrode G2 is integrally connected to the scan line Sn. For example, the switching gate electrode G2 is at the same layer as the scan line Sn on the substrate SUB, and includes a same material as the scan line Sn.

The switching active layer A2 is at a position corresponding to the switching gate electrode G2, and is between the substrate SUB and the switching gate electrode G2. The switching active layer A2 includes a channel region corresponding to the switching gate electrode G2, and a source region and a drain region separated from each other with the channel region therebetween. The switching source electrode S2 and the switching drain electrode D2 are respectively connected to the source region and the drain region of the switching active layer A2.

The switching source electrode S2 is integrally connected to the first data line DA1 or the second data line DA2. For example, the switching source electrode S2 is at the same layer as the first data line DA1 or the second data line DA2 on the scan line Sn, and includes the same material as the first data line DA1 or the second data line DA2. The switching drain electrode D2 is separated from the switching source electrode S2 via the switching gate electrode G2 interposed therebetween, and is connected to the second capacitor electrode CE2 of the capacitor C via the driving gate electrode G1 of the driving thin film transistor T1. The switching drain electrode D2 may include a same material as the first data line DA1 or the second data line DA2.

The driving thin film transistor T1 is connected to the organic light emitting element OLED, and includes a driving gate electrode G1, a driving active layer A1, a driving source electrode S1, and a driving drain electrode D1.

The driving gate electrode G1 is connected to the switching drain electrode D2 of the switching thin film transistor T2 and the second capacitor electrode CE2 of the capacitor C. The driving gate electrode G1 is connected to the first data line DA1 or the second data line DA2 through the switching thin film transistor T2. The driving gate electrode G1 is positioned at the same layer as the scan line Sn and includes a same material as the scan line Sn.

The driving active layer A1 is at a position corresponding to the driving gate electrode G1 and is between the substrate SUB and the driving gate electrode G1. The driving active layer A1 includes a channel region corresponding to the driving gate electrode G1, and a source region and a drain region separated from each other with the channel region therebetween.

The driving source electrode S1 and the driving drain electrode D1 are respectively connected to the source region and the drain region of the driving active layer A1. The driving source electrode S1 is connected to the driving power source line ELVDDL, and the driving drain electrode D1 is connected to the first electrode E1 as the anode of the organic light emitting element OLED. The driving source electrode S1 and the driving drain electrode D1 are positioned at the same layer, and include a same material as the first data line DA1 or the second data line DA2, and the driving power source line ELVDDL.

For example, the switching source electrode S2 of the switching thin film transistor T2 is connected to the first data line DA1 or the second data line DA2, and the switching gate electrode G2 of the switching thin film transistor T2 is connected to the scan line Sn. Also, the switching drain electrode D2 of the switching thin film transistor T2 is connected to the driving gate electrode G1 and is connected to the second capacitor electrode CE2 of the capacitor C through the driving gate electrode G1 Further, the driving source electrode S1 of the driving thin film transistor T1 is connected to the driving power source line ELVDDL. The driving drain electrode D1 is connected to the first electrode E1 as the anode of the organic light emitting element OLED.

The capacitor C includes the first capacitor electrode CE1 and the second capacitor electrode CE2 facing each other with the insulating layer therebetween. The first capacitor electrode CE1 is connected to the driving power source line ELVDDL.

The second capacitor electrode CE2 is connected to the first data line DA1 or the second data line DA2 through the driving gate electrode G1 and the switching thin film transistor T2.

The switching thin film transistor T2 serves as the switching element for selecting a pixel PE for light emission. When the switching thin film transistor T2 is turned on, the first capacitor electrode CE1 of the capacitor C is supplied with power from the power source through the driving power source line ELVDDL. Simultaneously, the second capacitor electrode CE2 is supplied with power from the power source through the first data line DA1 or the second data line DA2 through the switching thin film transistor T2. As a result, the capacitor C is charged. In this case, the charged charge amount is proportional to the voltage applied from the first data line DA1 or the second data line DA2. The voltage applied to the driving gate electrode G1 of the driving thin film transistor T1 is increased depending on the potential charged to the capacitor C.

The driving thin film transistor T1 is turned on when the voltage applied to the driving gate electrode G1 by the capacitor C is over the threshold voltage. Thus, the voltage applied to the driving power source line ELVDDL is applied to the organic light emitting element OLED based on current through the driving thin film transistor T1. As a result, the organic light emitting element OLED emits light. The current may be applied to the organic light emitting element OLED in proportion to the voltage of the data signal passing through the first data line DA1 or the second data line DA2. Accordingly, the emission luminance of the organic light emitting element (OLED) is controlled by the data signal passing through the first data line DA1 or the second data line DA2.

Thus, in the present embodiment, the first data drivers DD1 supply data signals to pixels PE at different regions in the upper side of the substrate SUB through the first data lines DA1, and the second data drivers DD2 supply data signals to the pixels PE at the different regions in the lower side of the substrate SUB through the second data lines DA2, which are separated from the first data lines DA1. As a result, the organic light emitting diode display 1000 may have high resolution with an increased number pixels PE, while at the same time suppressing delay of data signals through the first data lines DA1 and the second data lines DA2. By suppressing the delay of the data signals through the first and second data lines DA1 and DA2, adverse effects associated with emission luminance of the organic light emitting element OLED of each pixel PE may be reduced or minimized to achieve improved display quality.

In one embodiment, the organic light emitting diode display 1000 may further include a shielding portion BM overlapping an end portion (e.g., an edge) of the first data line DA1 and an end portion of the second data line DA2.

In one embodiment, the emission region (EA) of the organic light emitting element OLED does not overlap the gate wires GW including the scan line Sn, the data wires DW including the first data line DA1, the second data line DA2, and the driving power source line ELVDDL. the two thin film transistors T1 and T2, and the capacitor C. Also, the first electrode E1 may be a light translucent electrode and the second electrode E2 may be a light reflection electrode to form a bottom emission type of display emitting light in the direction of the substrate SUB.

If left unresolved, scattering or reflection of light may occur at the end portions of the first data line DA1 and the second data line DA2. In the present embodiment, the shielding portion BM overlaps the end portion of the first data line DA1 and the end portion (e.g., the edge) of the second data line DA2 between the substrate SUB, and the end portion of the first data line DA1 and the end portion (e.g., the edge) of the second data line DA2. As a result, the scattering or reflection of light at each end portion of the first data line DA1 and the second data line DA2 may be reduced so that it is not recognized through the substrate SUB.

The shielding portion BM is in a scan line Sn respectively overlapping the end portion of the first data line DA1 and the end portion of the second data line DA2. Thus, the shielding portion BM may be formed by the scan line Sn. In one embodiment, the shielding portion BM is formed in the scan line Sn at the same layer and includes a same material as the driving gate electrode G1 between the substrate SUB and the first data line DA1. As a result, the end portion of the first data line DA1 and the end portion of the second data line DA2 is not recognized outside through the substrate SUB.

Accordingly, since the scattering or reflection of light that may be respectively generated at the end portion of the first data line DA1 and the end portion of the second data line DA2 is not recognized outside through the substrate SUB, deterioration of the quality of the image displayed in the direction of the substrate SUB is suppressed.

For example, although the data wires are divided into the first data line DA1 and the second data line DA2 to suppress the delay of the data signal, any scattering or reflection of light that may be generated at each portion of the first data line DA1 and the second data line DA2 is suppressed from being recognized outside, thereby improving display quality of the organic light emitting diode display 1000.

Figure 4:
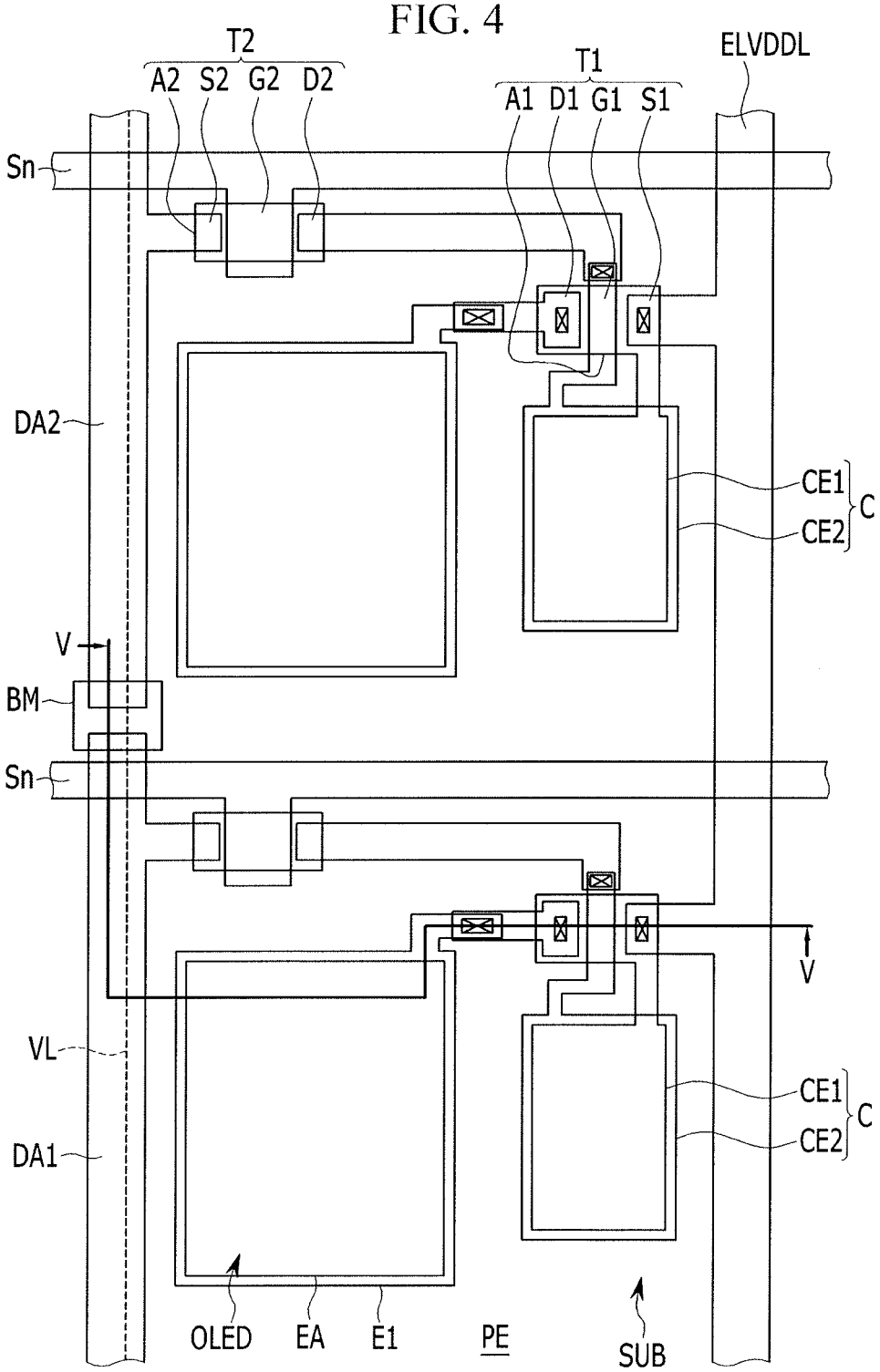
FIG. 4 illustrates another embodiment of an organic light emitting diode display.
Figure 5:
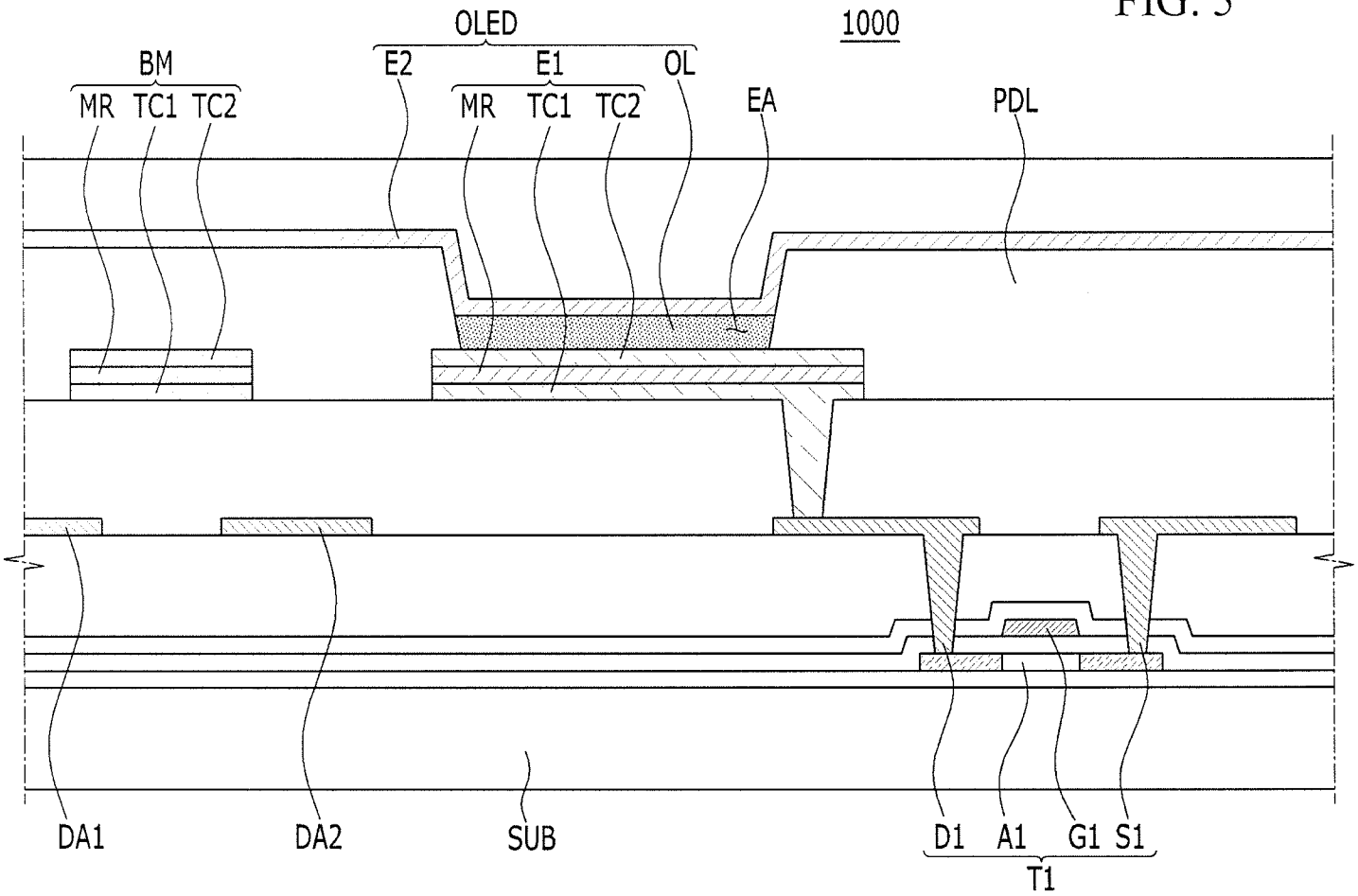
FIG. 5 illustrates a view along section line V-V in FIG. 4

FIG. 4 illustrates a layout view of another embodiment of the organic light emitting diode display 1000, and FIG. 5 illustrates a cross-sectional view taken along a line V-V in FIG. 4. As illustrated in FIGS. 4 and 5, the organic light emitting diode display 1000 further includes the shielding portion BM respectively overlapping the end portion of the first data line DA1 and the end portion (e.g., the edge) of the second data line DA2.

In this embodiment, the emission region EA of the organic light emitting element OLED does not overlap the gate wires GW including the scan line Sn, the data wires DW including the first data line DA1, the second data line DA2, and the driving power source line ELVDDL, the two thin film transistors T1 and T2, and the capacitor C. Also, the first electrode E1 is a light translucent electrode and the second electrode E2 is a light reflection electrode to form a bottom emission type display which displays an image in the direction of the substrate SUB. Even when scattering of light occurs at the end portion of the first data line DA1 and the end portion of the second data line DA2, since the shielding portion BM overlaps the end portion (the edge) of the first data line DA1 and the end portion (the edge) of the second data line DA2, the first data line DA1 and the second data line DA2 are recognized as a line shape connected by the shielding portion BM in the direction of the substrate SUB. As a result, the scattering of light generated at each end portion of the first data line DAI and the second data line DA2 is suppressed from being recognized through the substrate SUB.

The shielding portion BM is formed at the same layer as the first electrode E1 may have, for example, an island shape that is separated from the first electrode E1. By forming the shielding portion BM at the same layer and of the same material as the first electrode E1, the first transparent conductive layer TC1, the metal reflection layer MR, and the second transparent conductive layer TC2 that are sequentially deposited form a light translucent pattern.

The shielding portion BM is positioned on each end portion of the first data line DA1 and the second data line DA2, overlaps each end portion of the first data line DA1 and the second data line DA2, and is formed at the same layer as the first electrode E1. As a result, the line shape is recognized in which the first data line DA1 and the second data line DA2 are connected by the shielding portion BM in the substrate SUB. Since light scattering generated at the end portion of the first data line DA1 and the end portion of the second data line DA2 is suppressed from being recognized outside through the substrate SUB, deterioration of the image displayed in the substrate SUB direction is suppressed.

For example, although the data wires are divided into the first data line DA1 and the second data line DA2 to suppress delay of the data signal, any light scattering generated at each portion of the first data line DA1 and the second data line DA2 is suppressed from being recognized outside, thereby improving display quality.

By way of summation and review, a shielding portion is formed in a scan line Sn positioned at a same layer and made of a same material as a driving gate electrode between a supporting substrate and a first data line DA1. As a result, an end portion of the first data line DA1 and an end portion of a second data line DA2 is not recognized outside through the substrate SUB.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting diode display, comprising:

a substrate;

at least one first data line on the substrate and extending in a direction of an imaginary line;

at least one second data line separated from the at least one first data line and extending in the direction of the imaginary line;

a plurality of driving thin film transistors, each of the driving thin film transistors having a driving gate electrode connected to the at least one first data line or the at least one second data line; and a plurality of organic light emitting elements respectively connected to the driving thin film transistors; and a shielding portion respectively overlapping an end of the at least one first data line and an end of the at least one second data line wherein the at least one first data line is adjacent to a side of a first organic light emitting element of the organic light emitting elements in a first column and the at least one second data line is adjacent to a side of a second organic light emitting element of the organic light emitting elements in the first column, wherein the sides of the first and second organic light emitting element are the same side, and wherein the at least one first data line and the at least one second data line overlap the imaginary line.

2. The organic light emitting diode display as claimed in claim 1, wherein emission regions of the organic light emitting elements do not overlap the at least one first data line, the at least one second data line, and the driving thin film transistors.

3. The organic light emitting diode display as claimed in claim 1, wherein the shielding portion is at a same layer as the driving gate electrode.

4. The organic light emitting diode display as claimed in claim 3, further comprising:

a plurality of scan lines separated from each other and extending in a direction crossing the imaginary line.

5. The organic light emitting diode display as claimed in claim 4, wherein the scan lines are between the substrate and the at least one first data line, and wherein the shielding portion is included in at least one of the scan lines.

6. The organic light emitting diode display as claimed in claim 5, wherein the scan lines are at a same layer as the driving gate electrode.

7. The organic light emitting diode display as claimed in claim 4, further comprising:

a switching thin film transistor including a switching gate electrode connected to the scan line and connected between one of the at least one first data line or the at least one second data line and the driving gate electrode; and a driving power source line connected to the driving thin film transistor.

8. The organic light emitting diode display as claimed in claim 7, further comprising: a capacitor including capacitor electrodes respectively connected to the driving power source line and the driving gate electrode.

9. The organic light emitting diode display as claimed in claim 1, wherein the organic light emitting element includes:

a first electrode on the substrate;

a second electrode on the first electrode; and an organic emission layer between the first and second electrodes.

10. The organic light emitting diode display as claimed in claim 9, wherein:

the first electrode is a light translucent electrode; and the second electrode is a light reflection electrode.

11. The organic light emitting diode display as claimed in claim 9, wherein the shielding portion includes at least one layer at a same layer as at least one layer of the first electrode.

12. The organic light emitting diode display as claimed in claim 11, wherein the shielding portion has substantially an island shape.

13. The organic light emitting diode display as claimed in claim 11, wherein the shielding portion includes:

a first transparent conductive layer on the substrate;

a metal reflection layer on the first transparent conductive layer; and a second transparent conductive layer on the metal reflection layer.

14. The organic light emitting diode display as claimed in claim 1, further comprising:

a plurality of first data lines;

a plurality of second data lines; and the first data lines and the second data lines are separated from each other in a direction crossing the direction of the imaginary line.

15. The organic light emitting diode display as claimed in claim 14, further comprising:

at least one first data driver connected to the first data lines; and at least one second data driver connected to the second data lines.

16. The organic light emitting diode display as claimed in claim 15, further comprising:

a plurality of first data drivers; and a plurality of second data drivers.

17. The organic light emitting diode display as claimed in claim 16, wherein the at least one first data driver and the at least one second data driver respectively include a printed circuit board.

* * * * *